US006038834A

United States Patent [19]

Haley

[11] Patent Number: 6,038,834

[45] Date of Patent: Mar. 21, 2000

[54] FILM BUBBLE WRAP INTERLEAF

[75] Inventor: Tedford E. Haley, Appleton, Wis.

[73] Assignee: Appleton Papers, Inc., Appleton, Wis.

[21] Appl. No.: 09/197,502

[22] Filed: Nov. 23, 1998

Related U.S. Application Data

[62] Division of application No. 08/214,250, Mar. 17, 1994, Pat. No. 5,873,464.

[51] Int. Cl.[7] ..... B65B 11/04

[52] U.S. Cl. ..... 53/399; 53/441; 53/449; 53/465

[58] Field of Search ..... 53/399, 449, 441, 53/465, 172, 176, 211, 472, 139.5, 139.6, 139.7

[56] References Cited

U.S. PATENT DOCUMENTS

| | | | |
|---|---|---|---|
| 1,793,328 | 2/1931 | La Bombard et al. . | |
| 1,949,259 | 2/1934 | Salsman . | |
| 2,797,804 | 7/1957 | Pomeroy et al. . | |
| 3,288,353 | 11/1966 | McCullough . | |
| 3,390,762 | 7/1968 | Mernieks . | |
| 3,746,605 | 7/1973 | Dillon et al. . | |
| 3,769,145 | 10/1973 | Gresham et al. . | |
| 4,162,009 | 7/1979 | Schouten . | |
| 4,691,497 | 9/1987 | Lancaster | 53/399 |
| 4,869,939 | 9/1989 | Santo . | |
| 4,884,385 | 12/1989 | Mushinski et al. | 53/399 |
| 4,936,459 | 6/1990 | Mushinski et al. . | |
| 5,007,538 | 4/1991 | Mushinski et al. . | |
| 5,099,791 | 3/1992 | Kitagawa et al. . | |
| 5,114,012 | 5/1992 | Muschinski et al. | 206/523 |
| 5,143,775 | 9/1992 | Olsson et al. | 53/139.7 X |
| 5,247,747 | 9/1993 | Grey et al. | 53/472 |
| 5,850,918 | 12/1998 | Pienta | 53/399 |

*Primary Examiner*—Linda Johnson
*Attorney, Agent, or Firm*—Birch, Stewart, Kolasch & Birch, LLP

[57] ABSTRACT

A method for protecting a roll of pressure-sensitive paper and a package produced by the method uses bubble wrap and film to protect the roll of paper. The bubble wrap has a plurality of bubbles which permanently entrap air. These pockets of air in the bubble wrap cushion the roll of paper initially as well as over long periods of time.

2 Claims, 5 Drawing Sheets

FILM BUBBLE WRAP INTERLEAF

This application is a divisional of 08/214,250 Mar. 17, 1994, now U.S. Pat. No. 5,873,464.

BACKGROUND OF THE INVENTION

1. Field of the Invention

The present invention relates to a process for protecting a roll of pressure-sensitive paper and to the package produced by the process of simultaneously wrapping interleaved layers of stretch film and packaging bubble wrap onto the roll of pressure-sensitive paper.

2. Description of Background Art

In traditional stretch wrapping machinery, equipment which combines spiral wrapping of stretch film with limited non-spiral wrapping of a single face corrugated medium or a kraft wrap have been used. Such machines have been developed which provide foam wrap in one operation and then kraft wrap in a second operation, and have required a substantial amount of the wrapping process to be performed by hand.

Problems have occurred in the prior art with the existing foam/kraft packages. Specifically, these packages using kraft wrap cannot apply foam over the edge or a roll of pressure-sensitive carbonless paper without producing a bulky edge that makes roll stacking difficult. The absence of foam over the edge of the roll of carbonless paper leaves the roll subject to edge damage.

One solution to this problem was proposed in U.S. Pat. No. 4,884,385. In this arrangement, interleaved film and foam are automatically wrapped around the roll of carbonless paper.

While this procedure has worked well, it has been found that the foam can creep and compress during storage. Therefore, protection for the roll of carbonless paper would be reduced.

SUMMARY OF OBJECT OF THE INVENTION

Accordingly, it is a primary object of the present invention to provide package and a process for producing the package which will continually protect a roll of pressure-sensitive paper. Pressure sensitive paper for purposes of the invention is understood to refer to carbonless paper and also thermally sensitive paper, such as facsimile paper. Thermally sensitive paper has been found to mar or discolor from a combination of pressure and friction. The invention is primarily described with respect to a roll of carbonless paper but is equally applicable to thermally sensitive paper. This process will simultaneous wrap interleaved layers of stretch film and bubble wrap onto the roll of carbonless paper to form the package.

It is a further object of the present invention to provide a unique bubble wrap package for protecting a roll of pressure-sensitive paper which can be easily handled without damaging the paper and which can be achieved with relatively low production costs.

The objects of the present invention are fulfilled by a process for producing a package for protecting a roll of pressure-sensitive carbonless paper wherein a layer of stretch film is fed toward a roll of carbonless paper which has been located in a wrapping position. The film can be secured to the roll with double face tape. A layer of bubble wrap is then fed toward the roll of carbonless paper in the wrapping position subsequent to the feeding of the stretch film. The roll is rotated while in the wrapping position for simultaneously interleaving the stretch film and the bubble wrap during a wrapping operation. The feeding of the bubble wrap to the roll of carbonless paper is terminated, and the feeding of the stretch film to the roll is terminated subsequent to the termination of the bubble wrap.

A resultant bubble wrap package produced by the process for protecting a roll of pressure-sensitive paper includes interleaved bubble wrap and film wrapped around the outer periphery of the roll of pressure-sensitive paper, the interleaved bubble wrap and film overlapping the edges of the roll. Additionally, first and second end pieces are secured to the flat side walls thereof with double-faced splicing tape and flanged plastic core plugs. The bubble wrap package may thus be easily handled without damaging the roll of pressure-sensitive paper. Alternatively and preferably, as the first and second end pieces can be held flush and secured for the flat side walls by means of overlapping the interleaved bubble wrap and film over the edges of the roll and over the circumferential edges of the end pieces to hold them in place. In this alternative, the double faced splicing tape can be omitted. Plastic core plugs have been found to be optimal with either design.

Further scope of applicability of the present invention will become apparent from the detailed description given hereafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
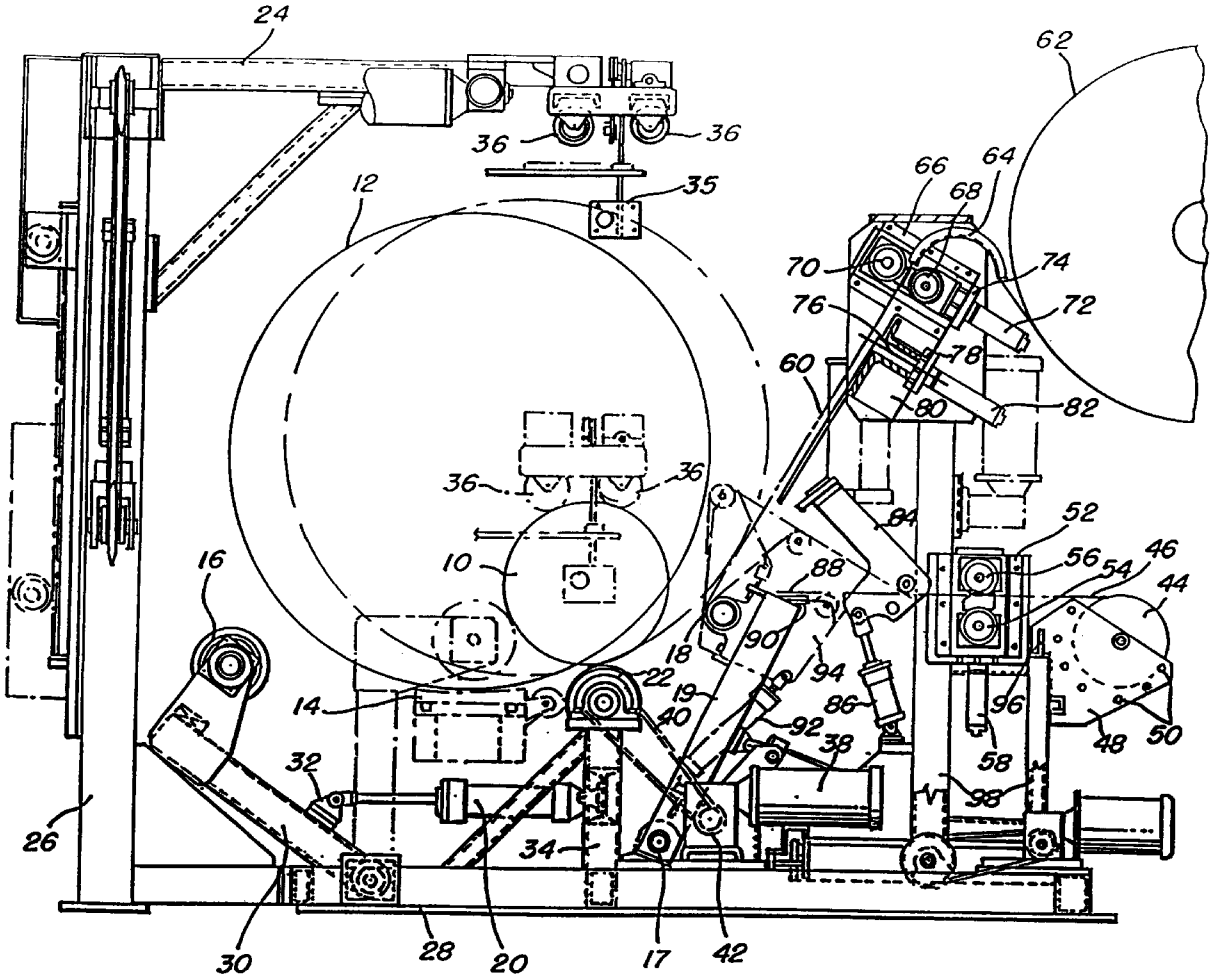
FIG. 1 is a side view of a device for providing core-horizontal interleaved bubble wrap and film wrapping around a roll of carbonless paper.

FIG. 1 is a side view of a device for providing core-horizontal interleaved bubble wrap and film wrapping around a roll of carbonless paper. A roll of carbonless paper typically varies from 24 inches in diameter such as that shown at 10, to 51 inches as a maximum diameter such as that shown at 12. Depending upon the end use of the carbonless paper, the width thereof will also vary. Unprotected rolls of pressure-sensitive paper are loaded onto a movable conveyor 14 prior to a wrapping operation. The conveyor 14 is then actuated to position the roll 10 or 12 in a rest position between a kicker roll 16 shown in its rest position and a nip roll 18 positioned in an opposing relationship to kicker roll 16. Nip roll 18 is affixed to one end of a nip roll arm 19 which pivots about a nip roll pivot shaft 17.

Kicker roll 16 is supported by a pivoting kicker arm 30, the kicker arm 30 is automatically actuated by hydraulic cylinder 20 to press the kicker roll 16 against a roll of carbonless paper, either roll 10 or roll 12, and press the same up into a wrapping position such that the weight of the roll of carbonless paper substantially rests on rotator roll 22. The carbonless roll of paper is thus securely positioned in a supporting relationship by kicker roll 16, rotator roll 22, and nip roll 18. The hydraulic cylinder 20 grips the kicker arm 30 via a mounting bracket 32 and is anchored at its opposing end to a rotator roll support 34. The rotator roll support 34 is fixed to base 28 of the wrapping structure.

A hold-down arm 24 is supported by a vertically extensible support beam 26 in an inverted "L" shape.

The base 28 supports the remainder of the bubble wrap and film wrapping subassemblies. A pair of opposing roll stabilizers 35 descend from wrapping arm 24 in combination with positioning rollers 36 to securely position the carbonless roll of paper in its wrapping position as it rests on rotator roll 22. At the start of the wrapping operation, rotator roll 22 rotates in a counterclockwise direction in order to rotate the carbonless roll in a clockwise direction. Rotation of the rotator roll 22 is accomplished by a first d.c. motor 38 or other similar power source which causes rotation of a drive sprocket 42 attached to base 28. A belt or chain 40 passes around drive sprocket 42 and the axis of rotator roll 22 to cause rotation thereof upon power-up of the motor 38.

Upon initiation of the rotation of the carbonless roll (10 or 12), stretch film 46 is fed from film roll 44 toward the rotating roll of carbonless paper. The leading edge of stretch film 46 may be secured to the carbonless roll by a double-faced splicing tape 88 at a vacuum plate 90 so that the stretch film 46 is attached to the carbonless roll upon its initial contact with the stretch film 46.

The vacuum plate 90 is supported by a vacuum plate actuator arm 94 which is in turn operated by a vacuum plate air cylinder 92.

The roll of stretch film 44 is held in a film cradle 48 and is in frictional contact with a plurality of spring retarded omni rollers 50 set in the film cradle 48.

The stretch film is guided through a pinch roll gib 52 including an idler pinch roll 54 and driven pinch roll 56. A spring return air cylinder 58 is provided in a position beneath the pinch roll gib 52 for selectively bringing the idler pinch roll 54 into contact with the driven pinch roll 56 when stretch film 56 is being fed toward the rotating carbonless roll.

After approximately one-half rotation of the carbonless roll, bubble wrap 60 is fed from a bubble wrap roll 62 through a bubble wrap guide 64 and a pinch roll mounting angle 66 toward the rotating roll until it is inserted between the stretch film 46 and the rotating carbonless roll at a tangential angle to the rotating carbonless roll. The pinch roll mounting angle 66 includes a bubble wrap idler pinch roll 68 and a bubble wrap driven pinch roll 70. A spring return air cylinder 72 is mounted to the pinch roll mounting angle 66 by a cylinder mounting plate 74. The spring return air cylinder 72 selectively brings the idler pinch roll 68 into contact with the driven pinch roll 70 when bubble wrap 60 is being fed from roll 62 toward the rotating carbonless roll.

The carbonless roll rotates so that stretch film 46 and packaging bubble wrap 60 are interleaved in a layered type relationship around the periphery of the carbonless roll. Usually three rotations of the carbonless roll are performed to adequately protect the carbonless roll, but any number of rotations required to achieve a desired roll protection are acceptable. When a sufficient number of rotations have occurred to provide an adequately wrapped package, a bubble wrap cutting knife 76 operates to slice the packaging bubble wrap 60. The bubble wrap cutting knife 76 is mounted within a bubble wrap cutoff slide plate 78 which is in turn formed on a bubble wrap cutoff mounting bracket 80. The bubble wrap cutting knife is responsive to the actuation of a spring return air cylinder 82 provided in connection with the bubble wrap cutoff slide plate 78. Subsequent to the cutting operation performed by the bubble wrap cutting knife 76, an adhesive applicator assembly, shown generally at 84, is positioned by an air cylinder 86 to direct adhesive toward the trailing edge of bubble wrap 60.

The stretch film 46 is cut by film cutting knife 96 after cutting of the packaging bubble wrap 60 has occurred so that the stretch film 46 will have a longer trailing edge than the packaging bubble wrap 60. Preferably, an additional two rotations of the carbonless roll should be provided in order to finish the wrapped carbonless roll with stretch film. As the stretch film 46 is wrapped around the carbonless roll, it is stretched at the peripheral surface of the roll such that any portions of stretch film 46 overlapping the roll edges tend to shrink and draw the packaging bubble wrap 60 up against the ends of the carbonless roll. Thus, there is a differential in the amount of tension applied to the stretch film 46 once it is wrapped around the carbonless roll, which aids in producing a compact final roll package.

Rotation of rotator roll 22 terminates when the wrapped package is complete, and kicker roll 16 falls backward to allow the wrapped package to come to rest once again on conveyor 14. Subsequently, conveyor 14 operates to move the wrapped package away from its position between kicker roll 16 and nip roll 18. The wrapped package can then be manually or automatically removed for convenient stacking and shipping without fear of damaging the carbonless paper thereunder.

While the film 46 has been discussed as being applied for one-half a rotation of the carbonless roll, it should be appreciated that the leading edges of the film 46 and bubble wrap 60 can simultaneously be applied to the carbonless roll or the bubble wrap 60 could instead be applied to the roll before the film 46. For example, the position of the roll of stretch film 44 and roll of bubble wrap 62 could be switched such that the bubble wrap 60 is fed past the double-faced splicing tape 88 at vacuum plate 90 to first reach the roll of carbonless paper before the film 46. Even when the bubble wrap 60 is first fed to the roll of carbonless paper or is simultaneously fed to the roll with the stretch film 46, the film can still be wound around the roll after the bubble wrap is cut in order to finally enclose the roll. It is also possible for the feeding of bubble wrap 62 to terminate simultaneously with the feeding of the film 46 or even terminate after the feeding of the film although such a sequence is not normally carried out.

The bubble wrap utilized in the present process is preferably a fixed width of 14 inches. Whenever a carbonless roll of paper being wrapped is greater in width than about 10½ inches, spiral wrapping is employed to provide sufficient roll surface protection and overlap at the edges of the carbonless roll. Spiral wrapping is achieved by automatically traversing frame member 98 which supports the bubble wrap packaging roll 62 and associated feeding elements, the stretch film roll 44 and associated feed elements, across the width of the carbonless roll until the entire width has been spirally wrapped. The remaining procedures are identical to that described in connection with the process of interleaving bubble wrap and film onto the carbonless roll in FIG. 1. In order to provide three layers of spiral wrapped bubble wrap, it will obviously be necessary to rotate the carbonless roll more than three times.

It should be noted that the rotator roll 22 may be substantially greater in width than the width of nip roll 18. This is due to the fact that nip roll 18 need not be of a much greater width than either the packaging bubble wrap 60 or stretch film 46 which is being applied to the carbonless roll of paper. The rotator roll 22, however, should be of a great enough width to rotate a relatively large cross-section of a carbonless roll. As such, a large roll can easily be rotated by rotator roll 22, and the carbonless roll can then be spiral wrapped for protection. This arrangement eliminates the need for varying widths of stretch film 46 and packaging bubble wrap 60, thus reducing material costs and the problems associated with predicting the widths of supplies.

Figure 2:
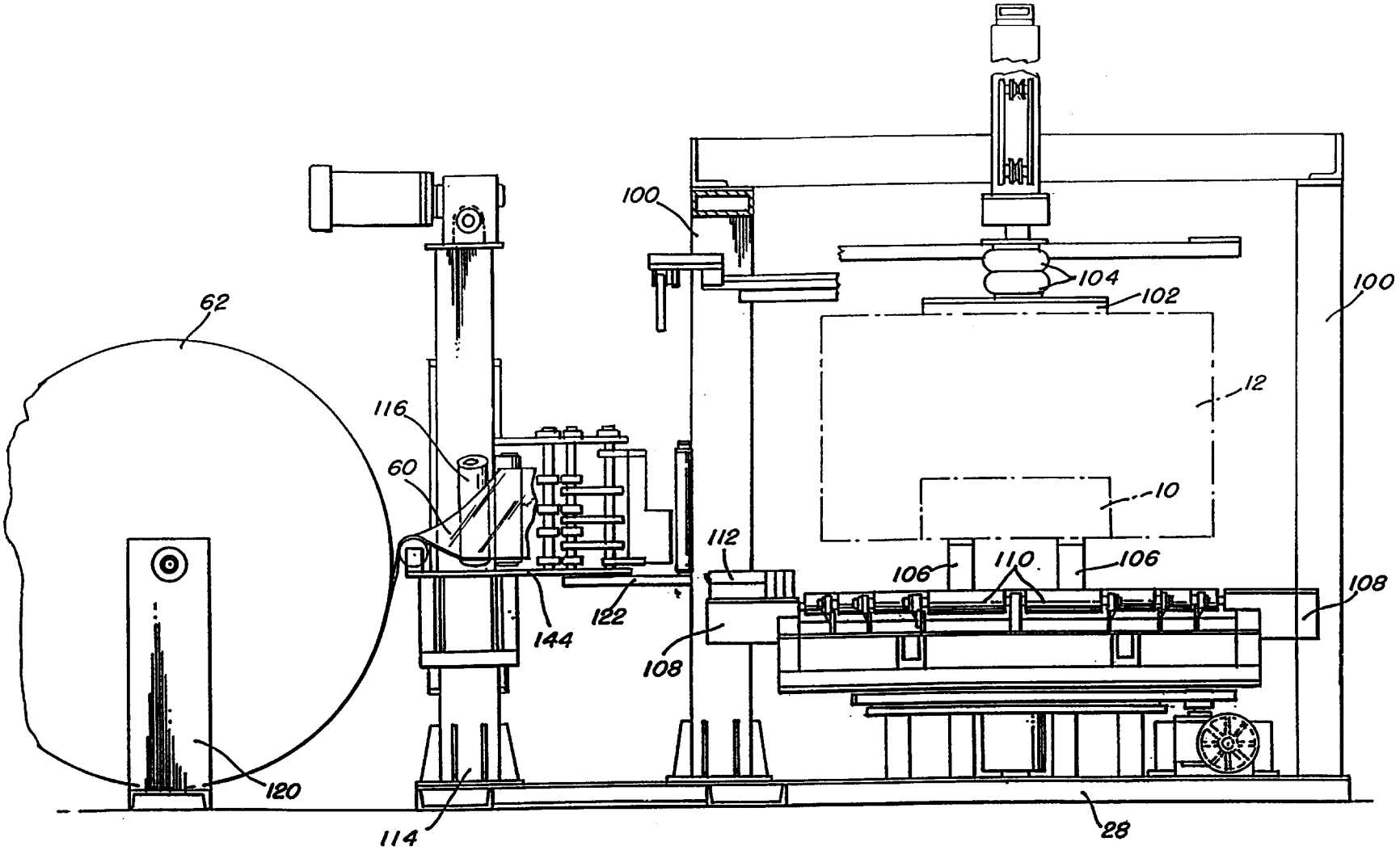
FIG. 2 is a side view of a device for providing core-vertical interleaved bubble wrap and film wrapping around a roll of carbonless paper.

FIG. 2 is a side view of a device for providing core-vertical interleaved bubble wrap and film wrapping around a roll of carbonless paper. In the core-vertical wrapping operation, frame 100 supports a top platen 102 upon which are provided air bags 104. Beneath the roll of carbonless paper 10 or 12, pop-up arms 106 are provided for lifting the carbonless roll off the conveyor 14 during a wrapping operation. Conveyor side frames 108 support a plurality of conveyor rollers 110 and a film clamping device 112. In the vertical wrapping operation, a vertical bubble wrap roll drive device 114, and a bubble wrap turning bar 116 with a bubble wrap dispensing head 118 are provided.

Figure 3:
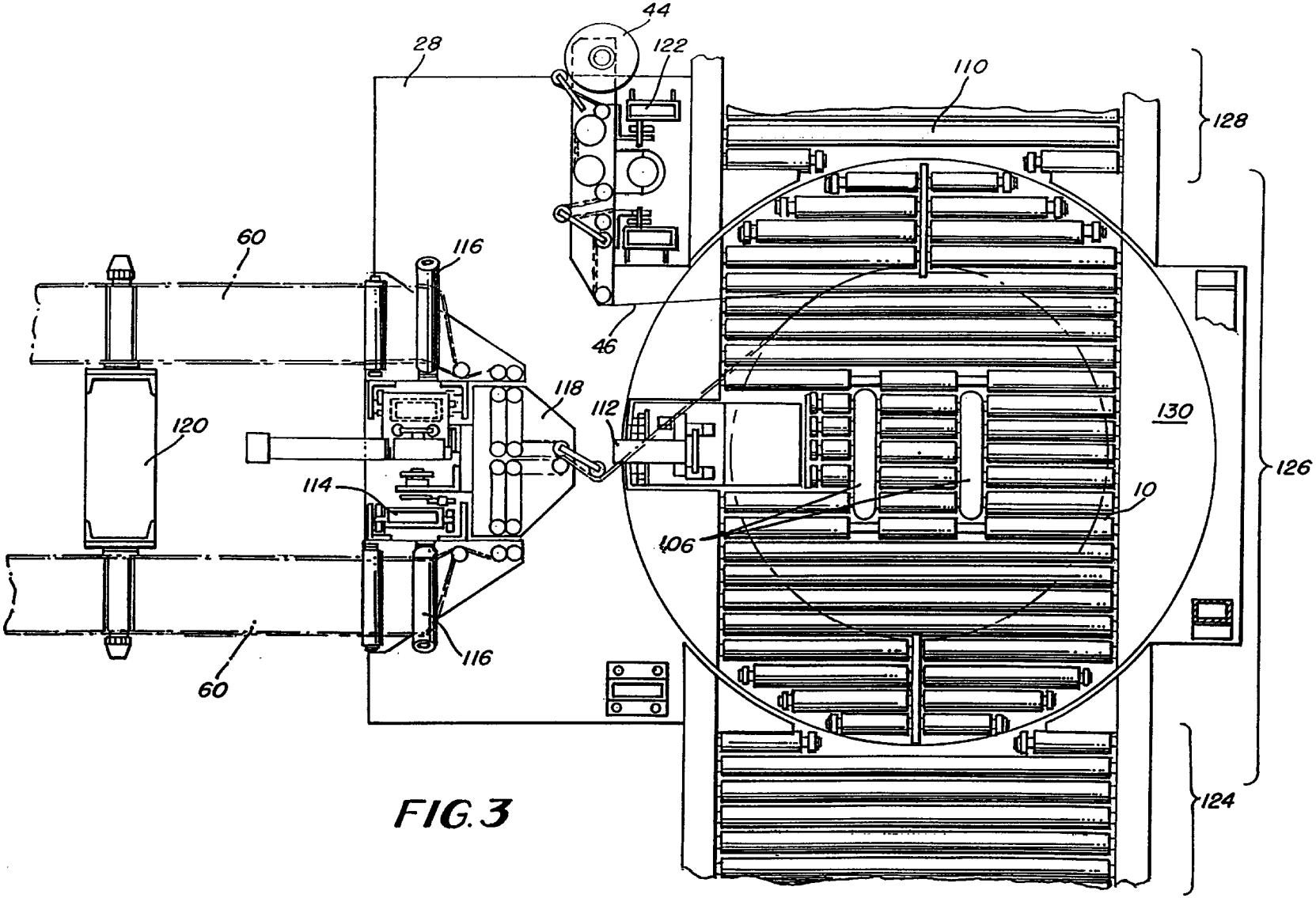
FIG. 3 is a top view of the core-vertical wrapping of FIG. 2.

FIG. 3 is a top view of the core-vertical wrapping device shown in FIG. 2.

It can be seen from FIG. 3 that there are two sources of packaging bubble wrap 60 which are fed from a bubble wrap roll mandrel 120 toward the bubble wrap dispensing head 118, such that upon depletion of one roll of bubble wrap, another may be immediately initiated in order to prevent substantial downtime during wrapping operations. It should be appreciated that the plurality of bubbles on the two bubble wrap sheets are not illustrated in this FIG. 3 to simplify the shown device. Similar to the device shown in FIG. 1, stretch film roll 44 dispenses stretch film 46 toward a rotating roll of carbonless paper. Subsequent to the initiation of wrapping by the stretch film 46, the packaging bubble wrap 60 is introduced at a tangentialangle between the film 46 and the rotating carbonless roll.

Spiral wrapping may also be achieved by a vertical traversing film dispenser 122 and a vertical traversing bubble wrap dispenser 144 which traverse up and down the length of the rotating carbonless roll during the wrapping operation.

As is also shown in FIG. 3, there is provided an in-feed conveyor section 124, a spinning conveyor portion 126, and an outfeed conveyor 128 which eliminates the need for manual handling of the rolls of carbonless paper except for initial loading and final unloading onto and from the conveyor, respectively.

The roll of carbonless paper 10 is rotated by a spinning conveyor 126 in a clockwise direction while packaging bubble wrap 60 and stretch film 46 are applied thereto. A turntable 130 is positioned such that pop-up arms 106 are centrally located beneath the carbonless roll and the spinning conveyor 126. The spinning conveyor 126 acts as a turntable in the wrapping operation, but then aids in the removal of the wrapped carbonless roll toward the outfeed conveyor 128 subsequent to a wrapping operation.

Figure 4:
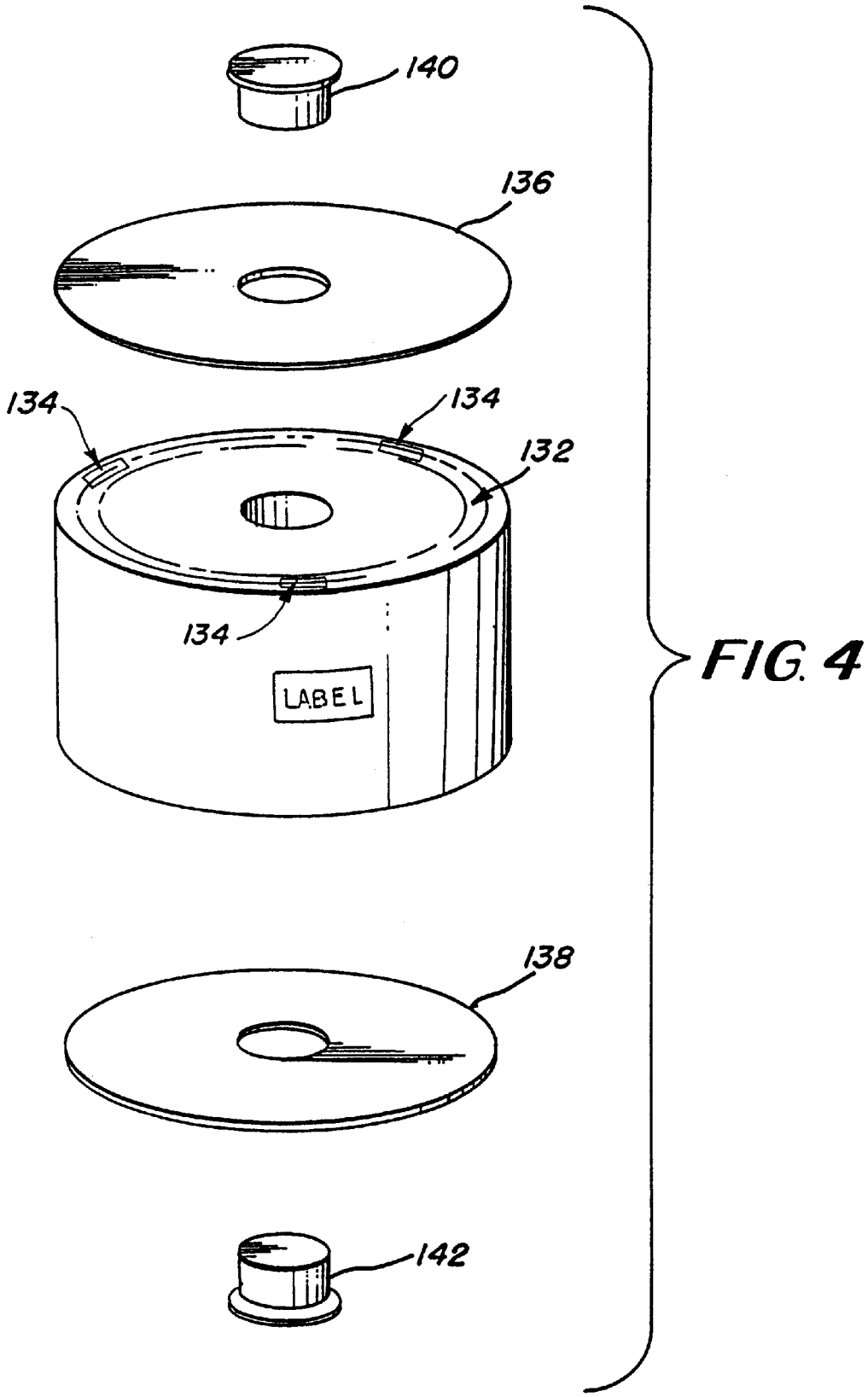
FIG. 4 is an exploded plan view of a completed wrapped package of the present invention also showing the optional core plugs.

FIG. 4 is an exploded plan view of a completed wrapped package of the present invention.

Regardless of the width of the roll of carbonless paper, the roll is covered with interleaved film and bubble wrap to a thickness of from ¼ to ½ inch or greater. The film and bubble wrap will overlap the edges of the carbonless roll as shown at 132 from about 2 to about 5 inches. Segments of a ¾ inch wide doublefaced tape 134 are applied to the film overlap 132 in a circular pattern approximately 1½ inches from the edge of the roll to the center of the tape so that end pieces 136 and 138 can be firmly affixed in a manual press-on type fashion to the film edge. The pieces are substantially the diameter of the wrapped package roll so that the entire roll of carbonless paper is protected by either film and bubble wrap or the corrugate headers. Core plugs 140 and 142 are pushed into the core of the carbonless roll in order to position and hold the end pieces flush to the roll. The resulting package is produced as a result of the wrapping process performed by the bubble wrap wrapper, and yield interleaved bubble wrap and film layers tightly wrapped about the face and edges of a roll of carbonless paper to provide a total package material thickness of from ¼ to ½ inch or greater. The finished package is free of wrinkles, bagginess and waffling and has a smooth tight overlap around the edges.

Figure 5A:
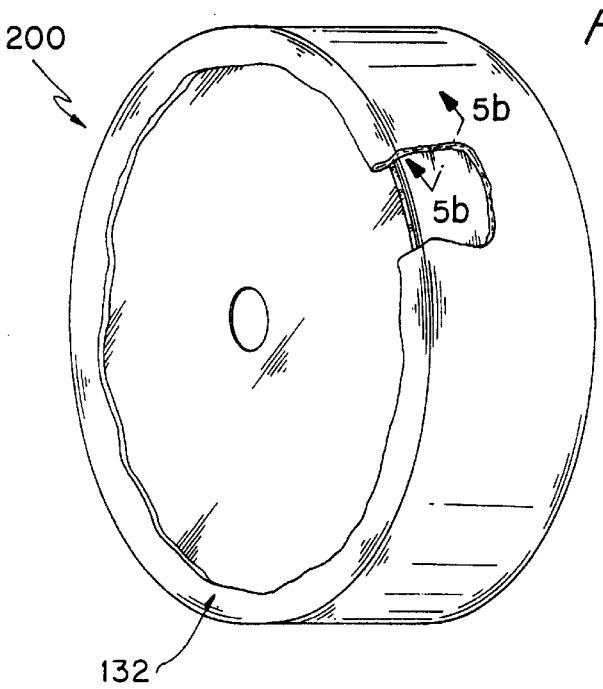
FIG. 5*a* is a perspective view with a partial cutaway of a roll of carbonless paper wrapped with multi-layers of bubble wrap and stretch material.
Figure 5C:
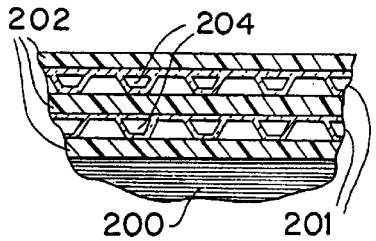
FIG. 5*c* is a partial cross-section view illustrating the layers of bubble wrap and stretch material on the roll of carbonless paper with the bubbles facing the roll of paper.
Figure 5B:
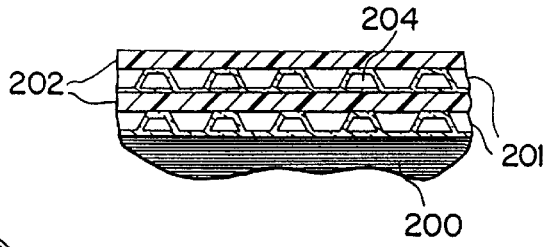
FIG. 5*b* is a partial cross-section view illustrating the layers of bubble wrap and stretch material on the roll of carbonless paper with the bubbles facing away from the roll of paper.

FIG. 5*a* illustrates a perspective view of a roll of carbonless paper 200. As illustrated in FIG. 5*b*, multi-layers of bubble wrap 201 and film 202 are applied to the outer surface of the roll of carbonless paper 200. In addition, multi-layers of bubble wrap 201 and film 202 overlap at 132 the end of the roll of carbonless paper 200. The multi-layers of bubble wrap 201 and film 202 may be applied to the outer surface of the roll of carbonless paper 200. The multi-layers of bubble wrap 201 and film 202 may be applied to the outer surface of the roll of carbonless paper 200 in as many layers as may be desired.

Figure 6:
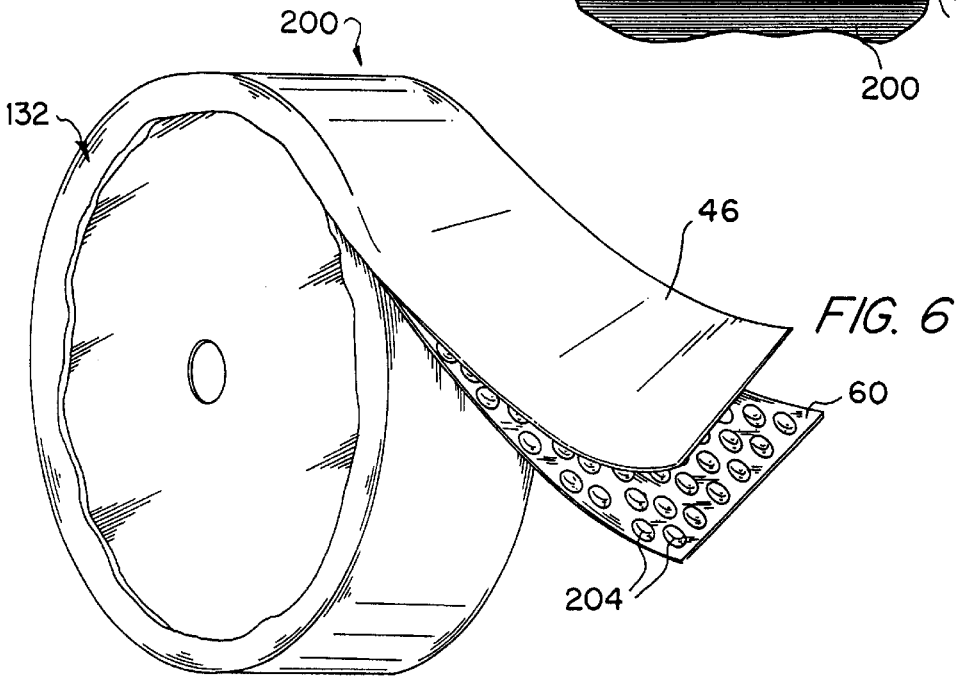
FIG. 6 is a perspective view of the bubble wrap package before the bubble wrap and stretch material are completely attached thereto.

To provide the bubble wrap process and package of the present invention, a stretch film of 150 gauge to 200 gauge of either low linear density polyethylene (LLDPE) or polyvinyl chloride (PVC) stretch film may be used. Additionally, the bubble wrap 60 can be made of plastic material. The sheet of bubble wrap can have a first side and second side with the first side being generally smooth and the second side having raised bubbles 204 as indicated in FIG. 6. It is contemplated that a plurality of bubbles 204 are provided on the sheet of bubble wrap 60. For example, 2½ bubbles per square inch (or 1 bubble per square centimeter) can be provided. Of course, the density of the bubbles on the sheet can be altered. For example, only a few large bubbles can be provided on the sheet. Also the thickness of the bubbles can be varied to be larger or smaller than that shown. Therefore, the volume of air entrapped by the bubbles can be designed to meet a user's particular needs. Moreover, the individual bubbles on a single sheet can have varying thicknesses if so desired. Also, bubbles 204 can be provided on one side of the sheet as shown, on both sides of the sheet or in some alternating pattern on the sides of the sheet.

Various common films are useful including polyethylene, nylon, polyvinyl chloride, saran and the like and blends of the foregoing. A more preferred bubble wrap material is a polyethylene with some nylon content as such was found to retain air better over time.

The bubbles 204 are sealed to permanently entrap air to thereby cushion the roll of carbonless paper 200. Therefore, these bubbles 204 act as means for entrapping air. It is contemplated that when bubbles 204 are provided on only one side of the sheet of bubble wrap 60, that the bubble side of the sheet will face in toward the roll of carbonless paper 200 and the smooth side will face outwardly as shown in FIG. 5*c*. The reverse configuration of bubbles out and smooth side facing the roll of carbonless paper as shown in FIG. 5*b* is useful but less preferred.

With the bubble wrap 60 and film 46 encircling the roll of carbonless paper 200, a film bubble wrap interleaf would be formed. The bubble wrap provides enhanced protection since foam appears to collapse during storage. The bubble wrap, on the other hand, retains a higher degree of cushioning initially and over time by virtue of the entrapped air. Overall protection of the roll is enhanced.

A double-faced splicing tape, approximately ¾ inch wide is optionally used with corrugate headers. The corrugate headers are of the "E" type with a 3 inch diameter center hole to correspond to the core of the roll of carbonless paper. Also optional are core plugs which can be of a plastic flanged type.

Although the invention is primarily described with regard to a roll of carbonless paper, it is equally applicable for other pressure sensitive rolls of paper such as thermally sensitive paper or facsimile paper.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for protecting a roll of pressure-sensitive paper, comprising the steps of:

providing a roll of carbonless paper;

supplying a layer of bubble wrap from a single source, the bubble wrap having a first side and a second side, the first side being generally smooth and the second side having a plurality of bubbles thereon;

supplying a layer of film from a single source;

wrapping the bubble wrap and film around the roll of carbonless paper, the first side of the bubble wrap facing the roll of paper;

rotating the roll of paper during the step of wrapping;

overlapping the bubble wrap and film with ends of the roll of paper; and terminating the wrapping of the bubble wrap around the roll of carbonless paper before terminating the wrapping of the film.

2. The method for protecting a roll of paper as recited in claim 1, further comprising the steps of:

applying segments of double-faced splicing tape in a generally circular pattern to edges of interleaved bubble wrap and film which overlap the ends of said roll of paper;

placing end pieces over the ends of the roll of paper, the end pieces covering the bubble wrap and film which overlap the ends of the roll; and holding the end pieces on the ends of the roll of paper with at least the double-faced splicing tape.

* * * * *